United States Patent [19]

Kronseder

[11] Patent Number: 4,683,835

[45] Date of Patent: Aug. 4, 1987

[54] LABELING STATION FOR BOTTLES OR THE LIKE

[76] Inventor: Hermann Kronseder, Regensburger Str. 42, 8404 Worth/Donau, Fed. Rep. of Germany

[21] Appl. No.: 856,831

[22] Filed: Apr. 28, 1986

[30] Foreign Application Priority Data

May 2, 1985 [DE] Fed. Rep. of Germany ..... 3515675

[51] Int. Cl.[4] ..... B05C 1/02

[52] U.S. Cl. ..... 118/231; 118/261

[58] Field of Search ..... 118/231, 261; 156/568, 156/571

[56] References Cited

U.S. PATENT DOCUMENTS 2,967,636 1/1961 Manas et al. ..... 156/571 X
4,226,660 10/1980 Carter ..... 156/571 X
4,512,842 4/1985 Schneider ..... 156/357

*Primary Examiner*—John P. McIntosh
*Attorney, Agent, or Firm*—Fuller, Puerner & Hohenfeldt

[57] ABSTRACT

A labeling device for bottles and the like features a rotor turning about a vertical axis and having a plurality of semi-circular glue pallets arranged in a circle on the rotor and oscillated through a limited angle as the rotor rotates. The pallets, after having contacted a glue coated roller, encounter the foremost label in a magazine and adhere to the label for moving the label to a transfer drum from which it is applied to the vessel in labeling position. The rotor is supported in a gear box and the glue roller is connected in a detachable manner at its end most remote from the gear box with a rigid arm having a stud shaft that engages the glue roller in a roller bearing. The arm is also provided with a stud shaft that makes a releasable connection with the rotor coincident with its axis to provide further support for the arm. One end of the arm is supported in alignment with the rotor shaft and the other end of the arm is supported in a releasable fashion in a stationary support and the top support for the glue roller is in between these two supports. Supporting the glue roller against deflection of its rotatable axis from vertical allows for setting the edge of a scraper blade that the thickness of the glue film on the glue roller at exactly optimal distance rather than an excessive distance with might otherwise be needed if the glue roller were not prohibited from deflecting as a result of the force of the pallets which roll onto it intermittently.

13 Claims, 2 Drawing Figures

255
25
24
23
37
42
41
39
36
34
35
28
33
40
29
13
6
22
35
26
33
34
27
5
30
4
3
2
7
8
11
12
32
14
15
1
20
18
16
19
17
410
58
38
31
59
57
9
52

LABELING STATION FOR BOTTLES OR THE LIKE

BACKGROUND OF THE INVENTION

This invention pertains to labeling machines and, in particular, to a device for applying glue to the labels before they are applied to containers such as bottles.

The basic features of a labeling station of the type of interest herein are described in many prior patents such as U.S. Pat. No. 4,512,842. The labeling machine of the type described in this patent has a rotor turning about a vertical axis. A number of glue pallets or label pick-off elements are arranged about the periphery of the rotor and these elements are usually driven by a cam so that they oscillate through a limited angle as the rotor rotates. As the pallets are rotated in a circular path, they roll on and off of a rotating roller that is coated with a thin film of glue, thereby depositing a film on the pallets. As the pallets rotate past a magazine containing labels, they contact successively the unprinted or backside of the foremost label with a rolling action so that the label picks up glue from the pallet and adheres to the curved surface of the pallet. The labels are then rotated successively to a transfer cylinder from which they are picked up directly or through intermediate means by passing bottles which rotate as they move to wrap the label about the bottle. The curved pallets or pick-off elements necessarily develop considerable contact pressure on the glue roller to pick up a uniform coating of glue. The thickness of the film of glue on the roller is controlled with a scraper blade. The edge of the blade runs lengthwise of the roller so that film thickness can be controlled by adjusting the blade toward and away from the surface of the roller to establish a gap corresponding to the desired glue film thickness.

Labeling stations of the type just outlined comprise a metal housing, called a gear box, and a power driven shaft extends vertically from the gear box and projects relatively far out from the gear box for supporting the roller over essentially its entire length. No other support for the glue roller has heretofore been provided at the upper end, probably, because no one had conceived how the upper free end of the glue roller shaft could be supported without interfering with disassembly of the parts of the glue applicator which is necessary for cleaning purposes. Even if a drive shaft having what might seem to be a greater than necessary diameter is used to obtain the desired stiffness of the drive shaft, deflection of the drive shaft to some degree is caused by the pressure of the pick-off pallets on the roller. In other words, the lateral force applied to the glue roller by the contacting pallets acts through a substantial moment arm which deflects the glue roller out of parallelism with the scraper blade. As a result, an optimal uniform glue film on the roller and, hence, on the pallets and labels is not maintained. Moreover, the glue scraper itself and its support can be deflected as the result of the pressure of the glue in the gap between the roller and scraper in the free area of the support which results in a non-uniform glue film thickness.

A result of the above mentioned conditions is that the optimal most economical glue film thickness setting cannot be maintained for a long period of time and it is often unavoidable to operate with a substantially thicker glue film on the glue roller than would be required for good label adhesion. Those skilled in the art will, of course, be aware that the glue film thickness must be critically controlled or the labels will be inclined to slip or float on the surface of the bottles. Moreover, if the glue film thickness is greater than necessary to achieve optimum adhesion, a substantial amount of glue will be wasted. During a single machine run, many thousands of labels will be applied and it will be found that glue consumption can increase dramatically far above expectations if the film thickness is not critically controlled.

SUMMARY OF THE INVENTION

Briefly stated, the present invention is a means for stabilizing the pallet carrying drum, the glue transfer roller and the scraper support to eliminate deflection from perfectly parallel axes so that a uniform and consistent film or coating of glue of optimal thickness will be applied to the pick-off pallets.

In a labeling machine according to the invention, a rigid arm is used in the manner of a dual connecting rod to maintain parallelism between the axes of the rotor and the glue roller and the support or the glue scraper so that during operation no misalignment or deflection from ideal position of these elements can occur. Furthermore, the rigidifying arm structure is so designed that it is still possible to easily remove the glue roller from its drive shaft as is often necessary for cleaning purposes by providing a detachable connection between the rigid arm and the glue roller. It also allows for easy removal of the pick-off elements or pallets on the rotor, if need be, without any obstruction after detaching the rigid arm. The scraper blade can also be easily removed for cleaning. How the features of the invention mentioned above are achieved will appear in the more detailed description of an embodiment of the invention which will now be set forth in reference to the drawing.

DESCRIPTION OF A PREFERRED EMBODIMENT

Figure 1:
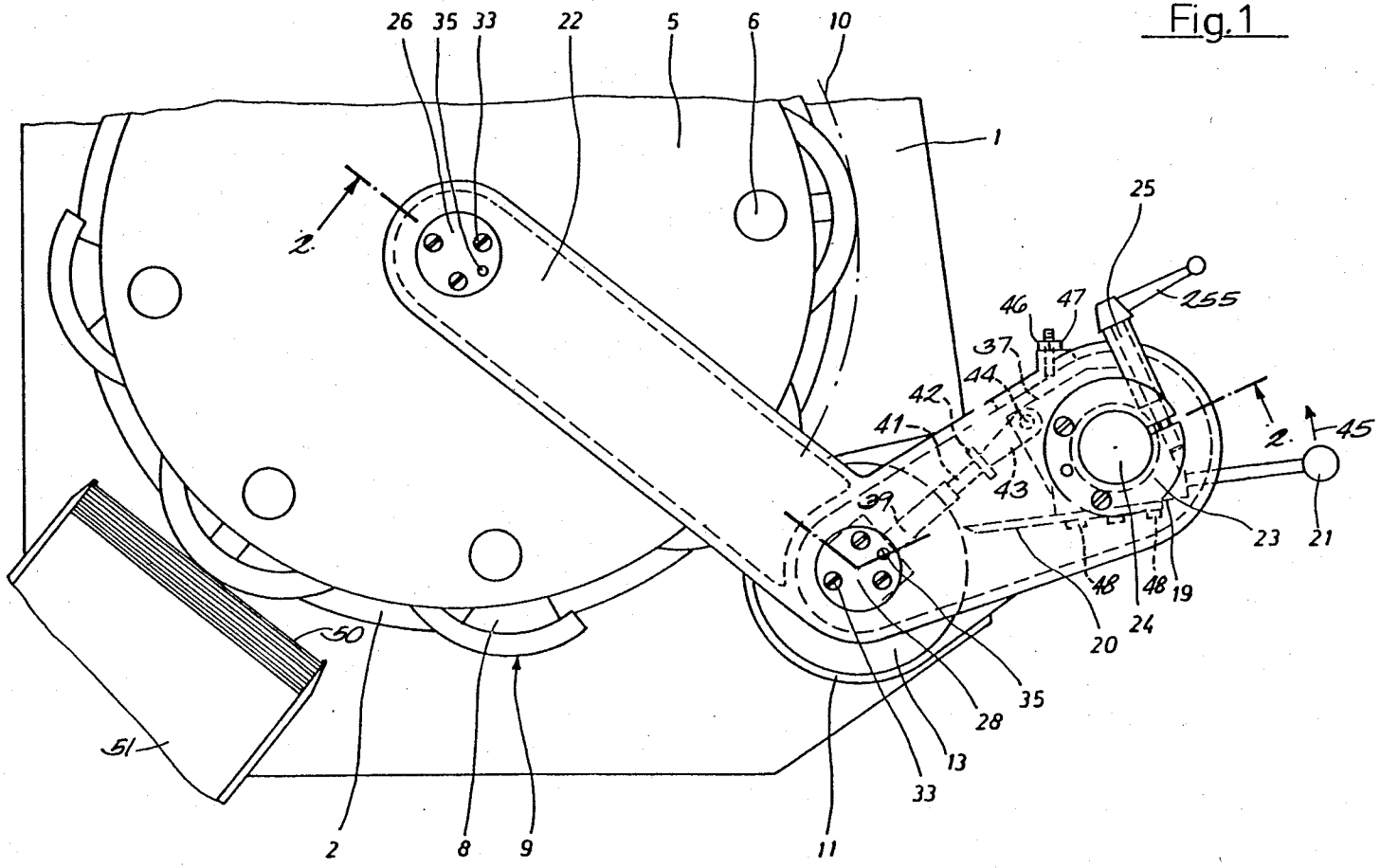
FIG. 1 is a partial plan view of a labeling station from which some known and indispensable parts are omitted for the sake of clarity.
Figure 2:
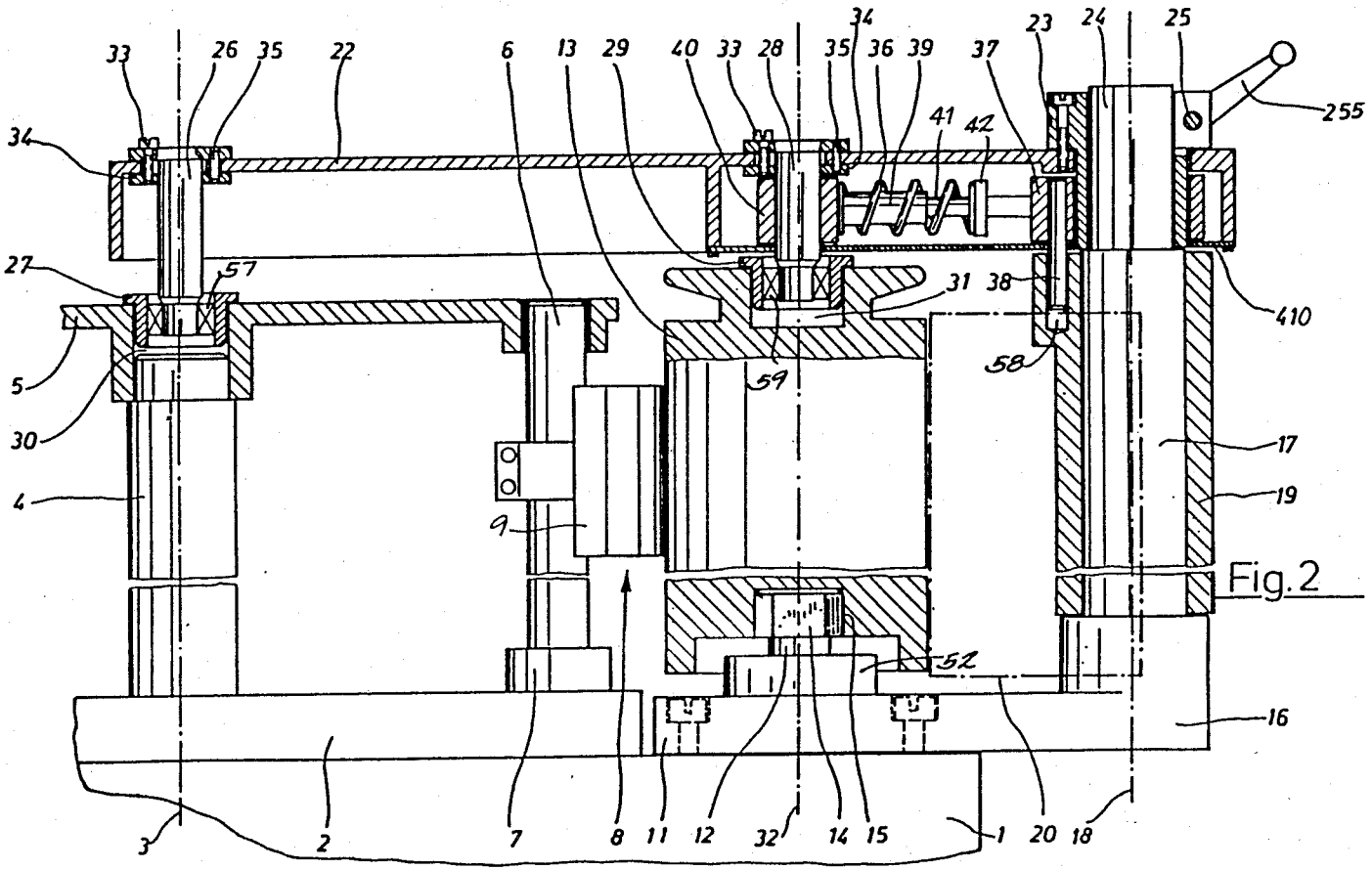
FIG. 2 is a vertical section taken on the offset line 2—2 in FIG. 1.

The labeling station depicted in FIGS. 1 and 2 is part of a labeling machine for applying labels to upright bottles, not shown, that are being revolved in a circular path past a location where a label on which a coating of glue has been applied is transferred to the bottle. In FIGS. 1 and 2, the label glue coating assembly comprises a housing 1 constituting a gear box, containing gear trains, not shown, for driving a rotor comprised of a lower circular plate 2 and an upper support plate 5. The means for driving a glue roller 13 concurrently are in gear box 1 but are not visible. Gear box 1 has an essentially flat top surface. A vertical rotatably driven shaft 4 extends upwardly and vertically from the gear box. Shaft 4 is driven and it drives lower and upper rotor plates 5 rotationally. A horizontal upper support plate 5 which is part of the rotor is mounted in a detachable manner on shaft 4. There are eight circumferentially spaced apart vertical shafts 6 arranged around the rotor with their axes parallel to the rotational axis 3 of shaft 4. The upper ends of shafts 6 are journalled in support plate 5 of the rotor in a detachable manner. The lower ends of shafts 6 have a polygonal cross-section and these lower ends fit into bushings 7 which have a complementarily shaped polygonal socket so that shafts 6 are easily removable from their driving sockets in bushings 7. In the gear box 1, not shown, there is a cam, not shown, for oscillating bushings 7 rotationally through repeatable cycles as the rotor comprised of upper support plate 5 and lower plate 2 rotate about the axis of shaft 4. On each shaft 6, there is at least one pick-off element 8 with a substantially semi-circular or partially cylindrical pallet 9 clamped onto oscillating shaft 6. Thus, as is evident in FIG. 1, as the pallets revolve on the rotor they oscillate on shafts 6 and make a rolling contact on the surface of a glue coated roller 13 which is depicted in FIG. 2, but not in FIG. 1. After the pallets 9 have a film of glue transferred to them from roller 13, the pallets, in their continued rotational course, make rolling contact with the unprinted side of the foremost label 50 that is one of a stack of labels held in a label magazine 51. As the pallets roll onto to the label 50, the label adheres in conformity with the contour of the pallet. This function is conventional. After the labels are adhered to successive pallets and carried along as the pallets revolve with the rotor the labels are picked off in a known manner by means which are not shown because they are well known to those skilled in the art and the matter of interest herein is the new means for stabilizing the parts of the glue applicator device to obtain a film of glue of uniform and predetermined constant thickness. The surfaces 9 on the pallets to which the labels are temporarily adhered are sometimes coated with vulcanized rubber so they are resilient to some degree.

The base 11 of a pedestal is attached to the top of gear box 1 and a drive shaft 12 extends through a bushing 52 which is fastened to the top of pedestal 11. The axis of drive shaft 12 must be parallel to the rotating shaft 4 which turns the rotor. Glue roller 13 is coupled to drive shaft 12. The drive shaft 12 projects only a short distance above the pedestal bearing 11 and at its upper end shaft 12 has a polygonal cross-section 14 which is received in a complementarily shaped socket 15 in the roller snugly but separably. The means, not shown, for driving shaft 12 rotationally are not shown but constitute gear means which are part of the mechanism in gear box 1. The driving coupling constituting the polygonal end on shaft 12 and corresponding socket 15 in glue roller 13 effects a driving connection between the shaft and glue roller. Note, that the shaft 12 does not extend to the full axially opposite end of the glue roller as has been common practice because maintaining these axes in parallelism is accomplished more effectively by means of the invention.

A laterally projecting horizontal arm 16 on the pedestal has the lower end of a cylindrical support 17 or stationary shaft fixed in it in a rigid manner. The central axis of shaft 17 is aligned in exact parallelism to the axis 3 of rotor shaft 4. A cylindrical sleeve 19 is supported for rotation on fixed shaft 17 and a glue scraper blade 20, as best seen in FIG. 1, is attached to sleeve 19 by means of screws 48. The free edge of scraper blade 20 is set at a distance from the periphery of glue roller 13 to provide a gap that corresponds in thickness with the desired thickness of the film of glue on the roller 13. Provision is made for swinging the glue scraper 20 completely away from glue roller 13 using a handle 21 which is attached to sleeve 19. The limit positions of the glue scraper are established by adjustable stops one of which is shown to take the form of an adjusting screw 46, which is threaded through arm 20 and has a lock nut 47 on it. Glue is applied to roller 13 in a conventional manner by way of a nozzle, not shown, which projects a stream of glue downwardly along the length of the roller surface. The surplus glue drains off at the lower end of the glue roller 13 and is collected in a trough, not shown, in accordance with well known practice and the excess glue collected in the trough is recirculated back to the glue reservoir, not shown. Of course, the thick coating of glue projected on the roller 13 by the nozzles is scraped off for being returned by the scraper blade 20.

In accordance with the invention, a rigid offset arm 22 is arranged in a horizontal plane at a right angle to the rotating shaft 4 of the rotor comprised of lower and upper plates 2 and 5 and to the central axis of the cylindrical stationary support shaft 17. As can be seen in FIG. 1, arm 22 is not straight but is offset and is comprised of two long integral legs joined at a vertex which is coincident with glue roller 13. Arm 22 consists essentially of a cast metal component having a U-shaped cross-section which has downwardly extending edges so it is open at the bottom like an inverted channel. In one of its two end regions of the arm 22, a centering bushing 23 is fastened. The bushing has a bore which is fitted to a tapered journal 24 constituting a reduced cross-sectional extension of stationary cylindrical support shaft 17. Centering bushing 23 is slotted longitudinally to facilitate clamping it on journal 24 by means of a clamping screw 25 to which a handle 255 is attached. Thus, the arm 22 is fixed at an exact height by bearing on the shoulder created at the juncture of the cylindrical support shaft 17 and its reduced cross-section cylindrical extension or journal 24.

At the end of arm 22 opposite from cylindrical support shaft 17, the arm 22 has a stud shaft 26 fastened to it. The stud shaft has an integral radially extending flange formed on it and the shaft 26 projects vertically downwardly and is designed for having its axis aligned with the axis 3 of rotor shaft 4. There is a flanged bushing 27 mounted in a bore 30 in upper rotor support plate 5. Bushing 27 contains a roller bearing 57 so the rotor can rotate relative to the stud shaft 26. Bushing 27 fits into bore 30 without freeplay and there is dimensional tolerance which permits bushing 27 to be withdrawn from bore 30 with a relatively minor force.

In the center of arm 22, specifically at the point of its bend or offset, a second stud shaft 28 is mounted to arm 22 and projects vertically downwardly in parallelism with the other stud shaft 26 which was just discussed. There is a flanged guide bushing 29 in a concentric counterbore 31 in the upper end of glue roller 13. A roller bearing 59 is fit into bushing 29. The lower end of stud shaft 28 fits into the inner race of bearing 59. Bushing 29 also fits into bore 31 without freeplay. Thus, the stud shafts 26 and 28 provide additional support for the main rotor 2 and glue roller 13, respectively, at the upper end of roller 13 and the rotor shaft 4 so these elements are supported against deflection and the axes of shaft 4 and roller 13 are compelled to remain in parallelism with each other. Moreover, the bending moment that would be produced by the edge of glue scraper 20 imparting a radially directed force on glue roller 13 is overcome. Now there are three supports remote from gear box 1, namely, stud shafts 26 and 28 and the engagement of centering bushing 23 on the fixed cylindrical support shaft 17.

In order to facilitate alignment or adjustment of the stud shafts 26 and 28, that is, to get the axis of the stud shafts 26 and 28 aligned with the axes of shaft 4 and glue roller 13 during manufacture of the labeling device, the stud shafts are anchored with floating fastening rings 34. The stud shafts fit through the top of arm 22 with some clearance. Three screws 33 pass through the flange of the stud shafts and these screws are threaded into corresponding holes in the fastening ring. After the stud shafts are moved around to obtain alignment with the axes of the rotor shaft and glue roller, screws 33 are tightened to prevent the stud shafts from shifting. After alignment is perfected, holes are drilled through the flange of the stud shaft and the associated clamping ring and dowel pins 35 are inserted to permanently lock the axes 3, 18 and 32 in parallelism. Thus, tilting or deflection of the glue roller 13 under the force of the glue pallets 8 and the force of scraper 20 on the glue roller cannot occur. Hence, the adjustment of the edge of scraper blade 20 relative to the periphery of glue roller 13 cannot change during operation of the device. The adjustment of the glue film thickness, therefore, is precisely maintained and the optimal and most economical coating thickness of the glue on the pallets 9 can be maintained. Yet, the arm 22 can be easily removed for permitting further removal of the glue roller and scraper for cleaning purposes by simply turning manually operable lever 25 to release the arm 22.

It will be recognized by skilled designers that the parts could be arranged conversely for making releasable or plug-in types of supporting connections between the arm means 22 and upper rotor plate 5 as well as the upper end of glue roller 13. That is, the bushing 27 and bearing 57 could be mounted to arm 22 instead of the rotor and the stud shaft 26 could be mounted in upper rotor plate 5 coaxial with shaft 4 so the stud shaft could project up instead of down and make a plug in connection with the bearing. Also, the stud shaft 28 could be fixed in the upper end of the glue roller 13 in place of bushing 29 and bearing 59 and the latter two elements could be mounted in arm 22. The stud shaft 28 would then project upwardly and make a plug-in connection with the bearing.

The hollow space existing at the bottom side of arm 22 is utilized for housing a pressure spring which is used to press scraper blade 20 towards the glue roller 13 until the scraper blade strikes an adjustable stop which is not shown. As previously pointed out, scraper blade 20 is fastened to long sleeve 19 on cylindrical support shaft 17 so sleeve 19 serves as a hinge for swinging scraper blade 20. The centering bushing 23 has a lever 37 fastened to it which provides for manually rotating sleeve 19. A pin 38 is fastened in rotatable centering bushing 37 and the lower end of pin 38 extends into a socket 58 in long sleeve 19. Thus, a detachable connection is formed between centering bushing 37 and long sleeve 19, facilitating removal of both of these components for cleaning. The hollow space under bridging arm 22 is enclosed with a perforated cover plate 410.

To obtain a spring force acting on blade 20, a telescoping arrangement comprised of a tube 39 is provided. Tube 39 is fixed to a bushing 40 through which stud 28 extends so the tube 39 can swivel on stud shaft 28. As can be seen best in FIG. 1, a link rod 41 extends into tube 39 and the tube and rod can telescope relative to each other. Rod 41 has a flattened end 43 which has a hole through which a pin 44 extends to pivotally connect the link to rotatable lever 37 which is turnable manually by using operating arm 21. Rod 41, as seen best in FIG. 2, has a collar fixed on it. Compression spring 36 in interposed between this collar on link 41 and the bushing 40 from which the tube 39 extends. Thus, as viewed from the top, the spring would tend to rotate sleeve 19 and hence, scraper blade 20 clockwise. Now, if arm 21 and the lever 37 to which it is attached are rotated slightly in the direction of the arrow 45 in FIG. 1, the edge of blade 20 will swing farther away from the periphery of glue roller 13 where the edge of the scraper is presently closest to the roller 13 although the gap between the blade edge and roller is enlarged for the sake of clarity. When operating arm 21 is urged in the direction of arrow 45, spring 36 is loaded and tends to drive the blade toward from the glue roller. However, when the blade is set, by using a thickness gauge or the like, at a distance that the provides the desired glue film thickness on the roller 13, a stop comprised of a threaded bolt 46 and a lock nut 47 is set. Then, spring 36 provides the force for keeping the edge of blade 20 in a fixed position relative to the periphery of glue roller 13.

The fit between flanged guide bushing 27 and hole 30 in top rotor plate 5 and the fit between the second guide bushing 29 and bore 31 in glue roller 13 as well as the fit between the non-slotted part of the centering bushing 23 and the journal 24 on the support shaft 17 are held to such tolerances that the two guide bushings 27 and 29 and the centering bushing 23 on journal 24 are such that the bushings can be slid off with reasonable manual force when removing arm 22. After releasing the clamping screw 25 by use of lever arm 255, the arm can be lifted vertically upwards from the labeling device without interference whereupon the guide bushings 27 and 28 come out of their bores 30 and 31, respectively. After removal of the arm, the glue roller 13 can be slid off of polygon coupling element 14 on drive shaft 12 and the glue scraper 20 can be lifted off of support 17 with long sleeve 19. Then the top plate 5 of the rotor can also be lifted off of center shaft 4 of the rotor. Then easy exchange of the planetary pallet carrying shafts 6 is possible. Arm 22, thus, does not obstruct the exchange or removal of the glue supplying elements and the device can be assembled and disassembled without the use of tools.

I claim:

1. A device for applying glue to labels for containers such as bottles, comprising:

a gear box;

a rotor and a rotationally driven rotor shaft projecting from said gear box to which shaft said rotor is mounted for rotation, at least one pick-off element mounted to said rotor for picking off a label when coated with glue, said element moving in a circular path with said rotor, a stationary support member mounted to said gear box and laterally spaced from said rotor, a glue roller arranged between said rotor and said support member for being contacted by said pick-off element, the rotational axis of said glue roller being parallel to the axis of said rotor shaft, a glue scraper mounted to said stationary support member for swinging toward and away from said glue roller about an axis that is parallel to the axes of said rotor and roller, a rotationally driven glue roller drive shaft projecting from said gear box and coupled to said glue roller coaxially with said roller, arm means and means for releasably clamping said arm means to said stationary support for said arm means to extend over said rotor shaft and said glue roller remotely from said gear box, means for making a rotatable and separable connection between the end of said glue roller most remote from said gear box and said arm means, and means for making a rotatable and separable connection between said arm means and said rotor at said end of the rotor shaft most remmote form said gear box.

2. The device according to claim 1 wherein:

said means for making a rotatable and separable connection between said arm means and said end of said glue roller comprises a cylindrical element extending from a selected one of said roller or said arm means and a bearing in the other of said roller and said arm means into which said element extends, and said means for making a rotatable and separable connection between said arm means and said rotor at said rotor shaft comprises a cylindrical element extending from a selected one of said rotor of said arm means and a bearing in the other of said rotor and said arm means into which said element extends.

3. The device according to claim 1 wherein:

said means for making a rotatable and separable connection between said glue roller and said arm means comprises a stud shaft fixed in said arm means and having an axis aligned with the axis of said roller and bushing means in said roller into which said stud shaft extends.

4. The device according to claim 1 wherein:

said means for making rotatable and separable connection between said arm means and said rotor comprises a stud shaft fixed in said arm means and having an axis aligned with the axis of said rotor and bushing means in said rotor into which said stud shaft extends.

5. A device for applying glue to labels for containers such as bottles, comprising:

a gear box, a rotor and a rotationally driven rotor shaft projecting from said gear box to which shaft said rotor is mounted for rotation, at least one pick-off element mounted to said rotor for picking off a label when coated with glue, said element moving in a circular path said rotor, a stationary support member mounted to said gear box and laterally spaced from said rotor, a glue roller arranged between said rotor and said support for being contacted by said pick-off element, the rotational axis of said glue roller being parallel to the axis of said rotor shaft, a rotationally driven glue roller drive shaft projecting from said gear box and coupled to said glue roller coaxially with said roller, arm means and means for releasably clamping said arm means to said stationary support for said arm means to extend over said rotor shaft and said glue roller remotely from said gear box, means for releasably and rotatably connecting the end of said glue roller most remote from said gear box and said arm means, and means for making a rotatable and separable connection between said arm means and said rotor coincident with said end of the rotor shaft most remote from said gear box, said stationary support member for said arm means being comprised of a stationary cylindrical member whose axis is parallel to the rotational axis of said glue roller and said rotor, said means for clamping said arm means to said stationary cylindrical member comprising a guide bushing fastened to the arm means fitted on said cylindrical member, said bushing having a longitudinally extending slot and a screw rotatable in said bushing on one side of said slot and threaded into said bushing on the other side of said slot, and means on said screw for rotating said screw in one direction to effect clamping of said bushing and said arm means to said cylindrical member.

6. The device according to claim 5 including:

a cylindrical sleeve fitted on a cylindrical part of said stationary support member, a scraper blade being fastened to said sleeve for swinging therewith where the said swinging axis is the axis of the sleeve, lever means mounted for turning on said guide bushing and means releasably coupling said lever means and said cylindrical sleeve for joint rotation, resilient means arranged for biasing said lever means for turning in one direction and stop means for limiting the amount said lever can turn in said one direction.

7. The device according to claim 6 wherein:

said resilient means comprises a bushing in said arm means whose axis is coaxial with the axis of said glue roller, a tubular element fastened to and extending radially from said bushing, a rod element having one end telescoping in said tubular element and another end pivotally connected to said lever means, means forming a collar on said rod and a biasing spring interposed between said bushing and said collar.

8. The device according to claim 6 wherein:

said means for coupling said lever means and cylindrical sleeve for joint rotation comprises a pin having one of its ends fitted in a hole in said lever means and its other end fitted in a hole in said cylindrical sleeve so that when lifting-off said arm means said sleeve and said arm means will disconnect.

9. A device for applying glue to labels for containers such as bottles comprising:

a gear box, a rotatably driven rotor shaft projecting from said gear box and a rotor mounted to said shaft for rotation about a vertical axis, said rotor comprising a lower generally circular member and an upper generally circular, member superimposed over and vertically spaced from said lower member, said upper member having a central axial bore fitted on said shaft in a manner to provide a counterbore in said upper circular member coaxial with said shaft and remote from said gear box, a glue roller arranged with its axis parallel to the axis of said rotor shaft, a rotatably driven shaft projecting from said gear box and means for coupling said shaft releasably in driving relation with said roller at the end of said roller nearest said gear box, said roller having a central counterbore at the end most remote from said gear box, at least one pick-off element mounted to said rotor for picking off a label by a coating of glue received by contacting said glue roller, a stationary cylindrical support shaft and means mounting said support shaft to said gear box with the axis of said support shaft parallel to and laterally spaced, from said rotor and from said roller, arm means and means for clamping said arm means to said cylindrical support shaft, said arm means extending from said shaft over said counterbores in said rotor and said roller, a bushing slidably fitting in the counterbore in said rotor and the counterbore in said roller, and a bearing in each bushing, a stud shaft mounted to said arm means and extending into said bearing in said bushing of the counterbore in said rotor, another stud shaft mounted to said arm means and extending into said bearing in said bushing of the counterbore in said roller, unclamping of said arm means allowing said arm means to be lifted off of said stationary support shaft and said bushings to withdraw said bushing means from said counterbores.

10. The device according to claim 9 wherein:

said means for coupling said drive shaft releasably to said glue roller comprises a polygonally shaped body formed on said drive shaft and a corresponding polygonally shaped socket in said end of said roller nearest said gear box.

11. A device for applying glue to labels for containers such as bottles comprising:

a gear box, a rotatably driven rotor shaft projecting from said gear box and a rotor mounted to said shaft for rotation about a vertical axis, said rotor comprising a lower generally circular member and an upper generally circular member superimposed over and vertically space from said lower member, said upper member having a central axial bore fitted on said shaft in a manner to provide a counterbore in said upper circular member coaxial with said shaft and remote from said gear box, a glue roller arranged with its axis parallel to the axis of said rotor shaft, a rotatably driven shaft projecting from said gear box and means for coupling said shaft releasably in driving relation with said roller at the end of said roller nearest said gear box, said roller having a central counterbore at the end most remote from said gear box, at least one pick-off element mounted to said rotor for picking off a label by a coating of glue received by contacting said glue roller, a stationary cylindrical support shaft and means mounting said support shaft to said gear box with the axis of said support shaft parallel to and laterally spaced from said rotor and from said roller, arm means and means for clamping said arm means to said cylindrical support shaft, said arm means extending from said shaft over said counterbores in said rotor and said roller, a bushing slidably fitting in the counterbore in said rotor and the counterbore in said roller, and a bearing in each bushing, a stud shaft mounted to said arm means and extending into said bearing said bushing of the counterbore in said rotor, another stud shaft mounted to said arm means and extending into said bearing in said bushing of the counterbore in said roller, unclamping of said arm means allowing said arm means to be lifted off of said stationary support shaft and said bushings to withdraw said bushing means from said counterbores, a cylindrical sleeve fitted on said stationary support shaft, a scraper blade mounted to said sleeve and extending toward said glue roller;

lever means mounted for turning on said stationary support shaft adjacent said cylindrical sleeve and means releasably coupling said lever means and sleeve for joint rotation, said lever means being retained in said arm means when said arm means is lifted off of said stationary support so that said sleeve and said scraper blade can be removed from said stationary support.

12. A device for applying glue to labels for containers such as bottles, comprising:

a gear box, a rotor and a rotationally driven rotor shaft projecting from said gear box to which shaft said rotor is mounted for rotation, at least one element mounted to said rotor for picking off a label when coated with glue, said element moving in a circular path with said rotor, a glue roller arranged for being contacted by said pick-off element, the rotational axis of said glue roller being parallel to the axis of said rotor shaft, a rotationally driven glue roller drive shaft projecting from said gear box and coupling in driving relation to one end of said glue roller coaxially with said roller, column means supported rigidly from said gear box and laterally spaced apart from the axis of said glue roller and from the axis of said rotor, a glue scraper mounted to said column means for swinging to cooperate with said glue roller about an axis that is parallel to the rotational axes of said glue roller and said rotor, a rigid bridging arm and means for alternatively fastening said bridging arm to said column means and for releasing said arm from said column means, said bridging arm extending laterally away from said column means across the axes of said rotor and said roller, means forming a rotatable and axially separable stabilizing connection between said bridging arm and rotor coaxially with the rotor, and means forming a rotatable and axially separable stabilizing connection between said bridging arm and said glue roller coaxially with the roller such that when said bridging arm is released from said column said arm is free to be moved in the axial direction to separate said connections and when said bridging arm is fastened said connections maintain the axes of said rotor, roller and scraper in parallelism.

13. The device according to claim 12 wherein:

said means forming said rotatable and separable connection between said bridging arm and said rotor comprises a shaft extending from a selected one of either the rotor or bridging arm and a bearing for the shaft in the other of the rotor or bridging arm, and said means for forming said rotatable connection between the bridging arm and said glue roller comprises a shaft extending from a selected one of either the glue roller or bridging arm and a bearing for the shaft in the other of the rotor or bridging arm.

* * * * *

UNITED STATES PATENT AND TRADEMARK OFFICE

CERTIFICATE OF CORRECTION

PATENT NO. : 4,683,835

DATED : August 4, 1987

INVENTOR(S) : Hermann Kronseder

It is certified that error appears in the above—identified patent and that said Letters Patent is hereby corrected as shown below:

| | |
|---|---|
| Claim 1, Column 6, Line 49 | After "box" delete ";" and substitute therefor ---,--- |
| Claim 1, Column 7, Line 10 | Delete "remmote form" and substitute therefor ---remote from--- |
| Claim 2, Column 7, Line 23 | Delete "of", second occurrence and substitute therefor ---or--- |
| Claim 4, Column 7, Line 35 | Before "rotatable" insert ---a--- |
| Claim 12, Column 10, Line 29 | Delete "coupling" and substitute therefor ---coupled--- |
| Claim 13, Column 10, Line 57 | Before "forming" insert ---for--- |

Signed and Sealed this

Fifth Day of January, 1988

*Attest:*

DONALD J. QUIGG

*Attesting Officer*

*Commissioner of Patents and Trademarks*